US005111115A

United States Patent [19]

Ball et al.

[11] Patent Number: 5,111,115

[45] Date of Patent: May 5, 1992

[54] FLUORESCENT LAMP CONTROLLER

[75] Inventors: David P. Ball, Swanson; Donald R. Ensor, Western Springs, both of New Zealand

[73] Assignees: Electronic & Transformer Engineering Limited; Vusion International Limited, both of Auckland, New Zealand

[21] Appl. No.: 638,528

[22] Filed: Jan. 8, 1991

[30] Foreign Application Priority Data

Feb. 5, 1990 [NZ] New Zealand ..... 232367

[51] Int. Cl.[5] ..... H05B 41/14

[52] U.S. Cl. ..... 315/239; 315/101; 315/205; 315/207; 315/DIG. 5

[58] Field of Search ..... 315/101, 105, 205, 206, 315/207, 239, DIG. 5, DIG. 2

[56] References Cited

U.S. PATENT DOCUMENTS 3,626,243 12/1971 Koyama et al. ..... 315/101
3,710,185 1/1973 Switson ..... 315/240
4,360,762 11/1982 Yamamoto et al. ..... 315/101

*Primary Examiner*—Eugene R. LaRoche
*Assistant Examiner*—Do Hyum Yoo
*Attorney, Agent, or Firm*—Young & Thompson

[57] ABSTRACT

A circuit suitable for the instantaneous starting, continuation, and interruption of current through one or more gasfilled discharge tubes, in particular fluorescent lamps, is described. The circuit and lamp heaters are energized before instantaneous control can occur. One preferred silicon controlled rectifier (SCR) is used with a bridge rectifier. The SCR has the dual role of causing the capacitor to discharge through the pulse transformer, the secondary pulse voltage of which thereby causes the arc to strike immediately upon application of gate current, and then maintianing the lamp current as long as a supply of SCR gate current is provided. A second preferred control device, a TRIAC, is used without a bridge rectifier and again has a dual role of pulse-starting and maintaining current. This type of device is more conveniently arranged to provide for a dimming function as well. Applications include "flashing" advertising signs, general illumination, and signals.

10 Claims, 9 Drawing Sheets

FLUORESCENT LAMP CONTROLLER

FIELD OF THE INVENTION

This invention relates to gas discharge lighting systems, and has particular application to low pressure gas discharge lamps, eg fluorescent lamps, although for some applications high pressure gas discharge lamps may be used. It is concerned with apparatus for igniting (or starting) gas discharge lamps, and has particular application to the repeated switching "on/off" of fluorescent lamps to allow "flashing" or controlled timing of the "on" and "off" periods.

BACKGROUND OF THE INVENTION

Gas discharge lamps are widely used for general illumination and offer substantial advantages such as efficiency, colour, coolness, and shape, over incandescent lamps. In particular, the conventional fluorescent lamp, namely a low pressure mercury vapor fluorescent electric discharge lamp, offers many advantages as a light source including high efficiency and good light distribution. However, control of the fluorescent lamp presents certain problems. Since it is a gas discharge device, a high starting voltage is required to initiate ionization and current limiting must be provided to avoid damage or destruction after ionization has taken place. In the past there has been a significant delay before light appears after supplying power. It has been particularly difficult to cause fluorescent lamps to repetitively turn on without flicker, at a desired instant, and without adversely affecting their operating life.

The "glow starters" widely used in fluorescent lamp fittings used for conventional lighting purposes—and which are unsuitable for flashing applications—typically have a shorter life than the lamps themselves.

PRIOR ART

The prior art circuits of FIG. 1*a* and 1*b* have been used to control fluorescent lamps. These circuits provide cathode heating, but rely on the mains voltage to strike the lamps. A conductive starting stripe running the length of the tube is often required to improve starting. These circuits are restricted to use with lamps that require a low voltage to strike the arc discharge. These are typically 38 mm diameter lamps. These earlier circuits have relatively long glow discharge periods, which reduce the lamp life. In multiple lamp circuits, the lamps often fail to strike at the same time. This is most noticeable in a long corridor lit by a number of fluorescent lamps when turned on by a single switch. Another prior art circuit is shown in FIG. 2.

The cathode at each end of a fluorescent lamp plays an important role in starting the electrical discharge in the internal gases. On first applying a voltage across the tube, there is practically no ionization and the gas behaves as an insulator. Once a few ions or electrons are present, a sufficiently high voltage accelerates these to provide more electrons by impact ionization of gas molecules within the tube, which in turn cause more impacts, and breakdown is achieved by a cumulative process or "avalanche". The cathodes may supply electrons at a very early stage in the breakdown process by field, photo-electric, and thermionic emission. If the cathodes are pre-heated excess electrons are provided by thermionic emission, and the strike voltage is greatly reduced.

Glow discharge occurs before the avalanche breakdown and the subsequent are discharge. During the glow discharge period, energetic electrons are accelerated to high velocities, bombarding the cathodes and dislodging emissive material by a sputtering process. This reduces lamp life and causes obvious deposition of dark material on the ends of the lamp surrounding the cathode. It is important to ensure that the glow discharge period is made as short as possible. Lamp end blackening may also be caused by excessive heating of the cathodes, or heating for an excessive duration, wherein the emissive material is simply vaporised off the cathodes.

In the field of low pressure gas discharge lamp technology, the terms "rapid starting" or "instant starting" have been used widely to imply relatively quick starting after power is applied to the fixture, but this is not instantaneous starting according to the usage of this present invention (which is within a millisecond after the arrival of a control pulse to an already energised lamp control unit). By way of example Yamamoto in U.S. Pat. No. 4,360,762 issued Nov. 23, 1982, refers to "rapid firing of a fluorescent lamp within 0.8 seconds".

Switsen U.S. Pat. No. 3,710,185 issued Jan. 9, 1973, describes a means for controlling a fluorescent lamp so as to make it flash, by causing a controllably conductive device in parallel with the lamp to bypass the current and thereby dim the lamp at a rate of at least five times per second. Presumably each dimming pulse cannot last for long (not many milliseconds) nor can the circuit be used for many kinds of fluorescent lamp as means to ignite or re-start the lamp are not disclosed.

Koyama U.S. Pat. No. 3,626,243 issued Dec. 7, 1971, discloses a capacitor, SCR, and transformer placed in parallel with a fluorescent lamp to provide a high-voltage ignition pulse for instantaneous starting. The triggering device used to complete the discharge circuit has a breakdown voltage intermediate between the voltage across the ignited lamp and the peak-to-peak mains supply voltage. Means for on-off switching control is not disclosed.

SUMMARY OF THE INVENTION

It is an object of the present invention to provide improved apparatus for igniting a gas discharge lamp, or at least to provide the public with a useful choice.

In one aspect the invention provides apparatus capable of creating a brief high-voltage pulse to initiate current discharge within a low-pressure gas discharge lamp (such as a fluorescent lamp).

In another aspect the invention provides apparatus which can create the brief pulse in response to the onset of a flow of current into the control input of a device having controllable conduction properties such as a thyristor alias SCR (silicon controlled rectifier) bidirectional TRIAC, or other semiconductor switching means.

In another aspect, the invention provides apparatus for providing from a source of alternating electric power the igniting and operating voltages for a gas discharge lamp, or lamps in series, said apparatus comprising step-up transforming means having primary and secondary windings, switching means, and charge storage means, wherein said switching means and said charge storage means are connected in series with said primary windings to provide, when said switching means is closed, a series resonant circuit; and wherein said secondary winding is connectable between a gas discharge lamp and a source of alternating electric power; whereby in use, the switching "on" of said switching means will cause said charge storage means to discharge transient current through said primary winding, causing an ignition pulse of high voltage to be created within said secondary winding available to ignite said gas discharge lamp or lamps, and once ignited said lamp or lamps can continue to draw current from said power supply via said secondary winding.

In a further aspect, the invention provides a lighting circuit comprising a low pressure gas-discharge lamp, or a plurality of said lamps connected in series, the or each lamp having resistively heated cathodes, means for connecting said lamp or lamps to a source of alternating electric power, and means for igniting said lamp or lamps, said igniting means comprising step-up transforming means having primary and secondary windings, semiconductor switching means, and a capacitor, wherein said switching means and said capacitor are connected in series with said primary winding to provide when said switching means is closed a series resonant circuit, and wherein said secondary winding is connected between said switching means and a cathode of the lamp, or a cathode of a first lamp in the series of lamps, whereby in use, the switching "on" of said switching means will cause said capacitor to discharge transient current through said primary winding causing an ignition pulse of high voltage to be created within said lamp or lamps, and once ignited said lamp or lamps can continue to draw current from said power supply via said secondary winding.

In a further aspect the invention provides for a device which can permit the flow of current through the fluorescent lamp for an indefinite period; such period being substantially equal to the duration of the current or voltage fed to the control electrode of the said semiconductor device. Indeed, if a suitable transistor or a gate turnoff GTO semiconductor device (for example) is used, illumination may be halted at any time independent of zero crossings, though in practice the decay time of the fluorescent phosphor coating inside the lamp may detract from instantaneous cessation of light.

In relation to the above aspect, to break the flow of current through the inductive load presented by the conventional ballast at times other than when the current flow is zero results in high-voltage impulses, and arcing at the mechanical switch if used.

The invention also provides an advertising display, in which the novel circuit is incorporated together with a suitable low pressure gas discharge lamp or lamps so as to provide illumination for marks or indicia made visible to the public, and in which flashing may render such marks or indicia more likely to be observed.

These and other aspects of this invention, which should be considered in all its novel aspects, will become apparent from the following description, which is given by way of example only, with reference to the accompanying drawings, in which:

PRIOR ART CIRCUITS

Figure 1A:
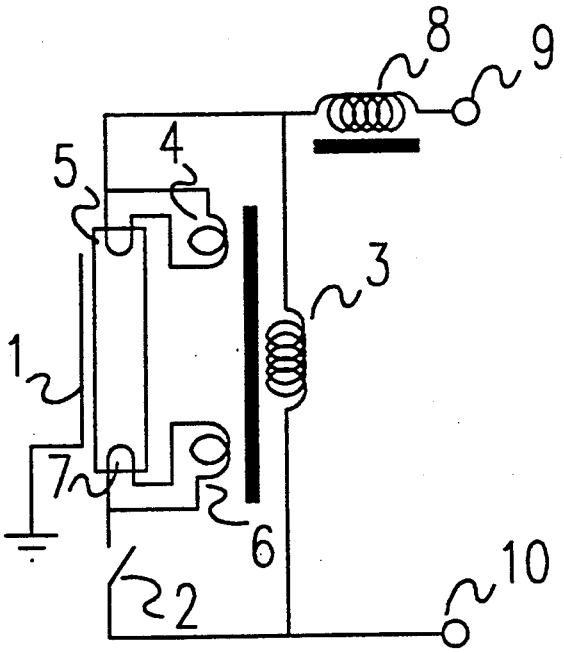
PRIOR ART Figure 1a
FIGS. 1*a*/1*b*: illustrate two conventional types of fluorescent lamp starter.
Figure 1B:
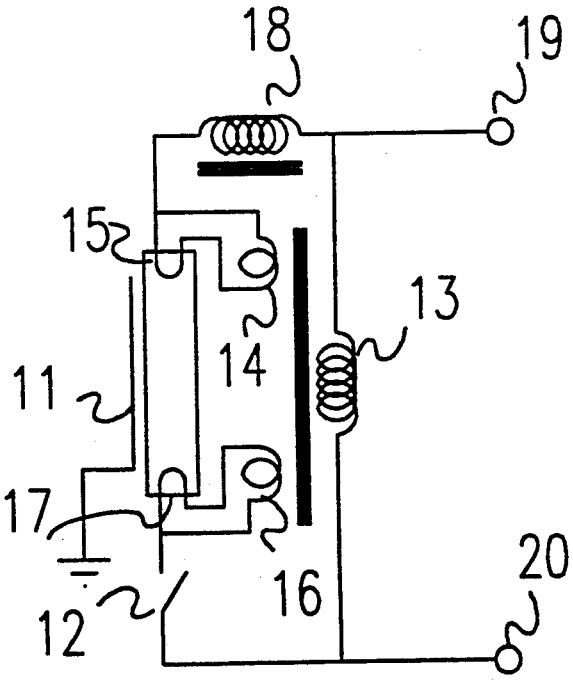
Figure 1b PRIOR ART
Figure 2:
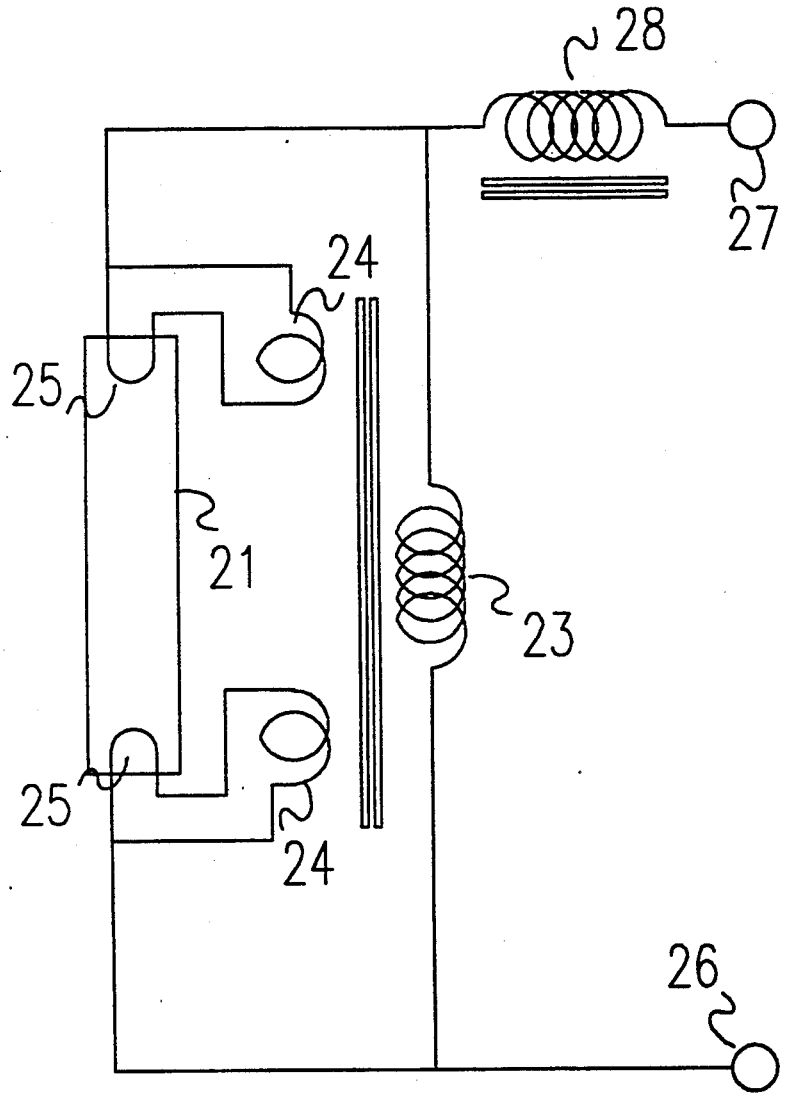
PRIOR ART Figure 2
FIG. 2: is an illustration of the conventional "Quickstart" circuit for starting certain kinds of low-voltage fluorescent lamp.

Reference to the prior art as illustrated in FIGS. 1*a*, 1*b* and 2 shall be made to assist in describing the preferred embodiments in FIGS. 3 to 8.

FIGS. 1*a* and 1*b* show two conventional types of fluorescent lamp starter. In the upper drawing (FIG. 1*a*) the AC mains supply is fed to connectors 9 and 10. The numerals in FIG. 1*b* will be shown in brackets as they relate to the same components, ie the connectors in the lower figure are [19, 20]. The primary winding 3 [13] with 4 [14] and 6 [16] as secondaries represent a transformer to heat the filaments 5 [15] and 7 [17] of the fluorescent lamp. 1 [11] is a grounded conductive strip which serves to focus the internal electrostatic fields and enhance the extent of ionisation of the gas. 2 [12] represents a starter or switch. 8 [18] represents an inductive element, the ballast, used to limit the alternating current flowing through the lamp since ionised gas has a negative resistance. During use, the ignited lamp has a lower voltage across it, so the voltage across the heater transformer is substantially reduced, in turn reducing the heater currents.

In the lower illustration, FIG. 1*b*, the position of the ballast 18 has been altered from its position in FIG. 1*a*. This means that the lamp filaments are run at full power.

FIG. 2 shows the conventional "Quickstart" circuit for starting a low-voltage fluorescent lamp 21, again equipped with cathode heating from the transformer windings 24, 24. In this circuit the mains supply is connected to 26 and 27; however this type of circuit is capable of striking a discharge between the heated cathodes 25, 25 without extra voltage pulses. This circuit is capable of striking a discharge in only a limited range of 38 mm diameter fluorescent lamps.

DESCRIPTION OF THE PREFERRED EMBODIMENTS

These details, as are those in the illustrations outlined above, are given by way of example and are in no way intended to be limiting. Variations on the preferred embodiments may be seen by readers skilled in the art, but will lie within the scope of the invention.

Figure 3:
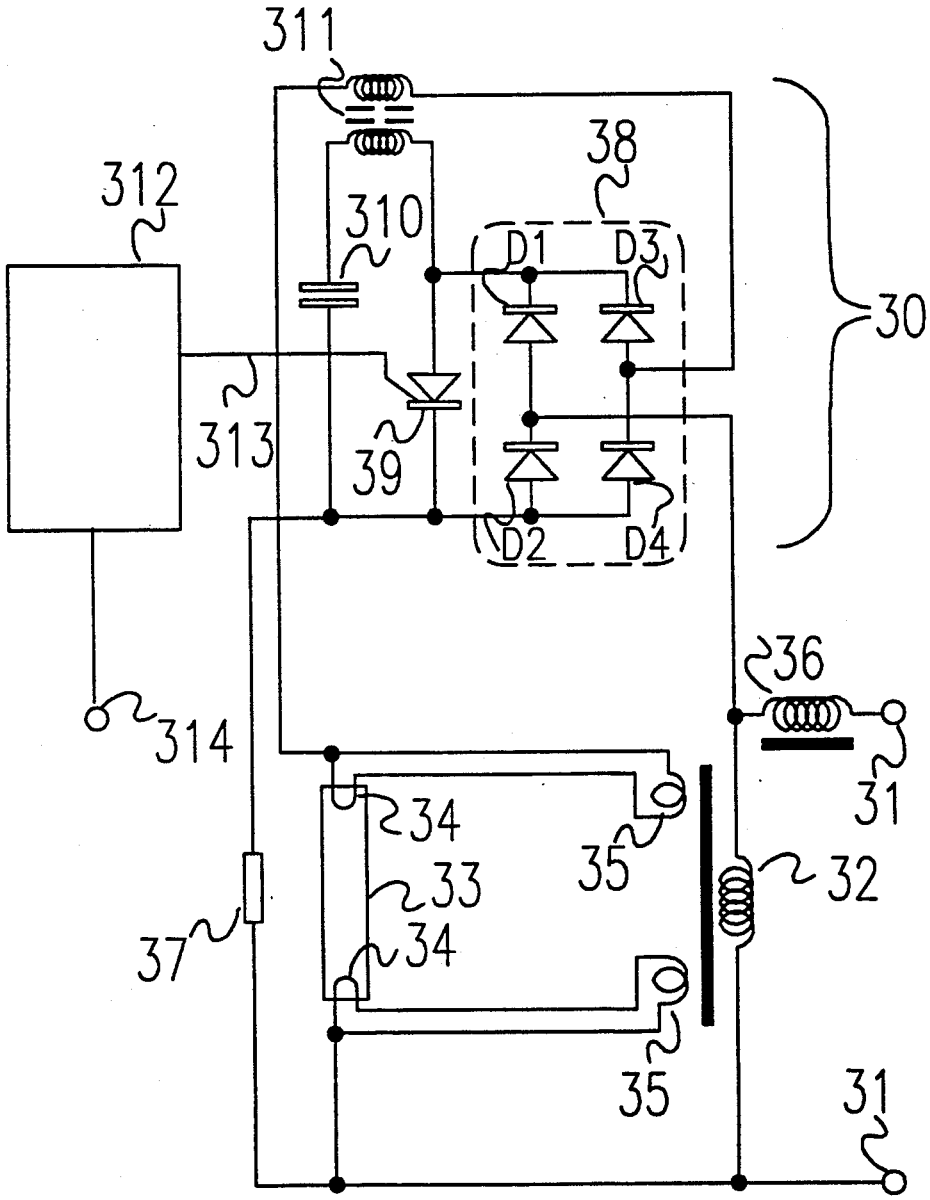
FIG. 3: is an illustration of a preferred embodiment of the present invention showing the circuit elements of the solid-state pulse-start and current maintenance circuits connected to a mains-driven fluorescent lamp.
Figure 8:
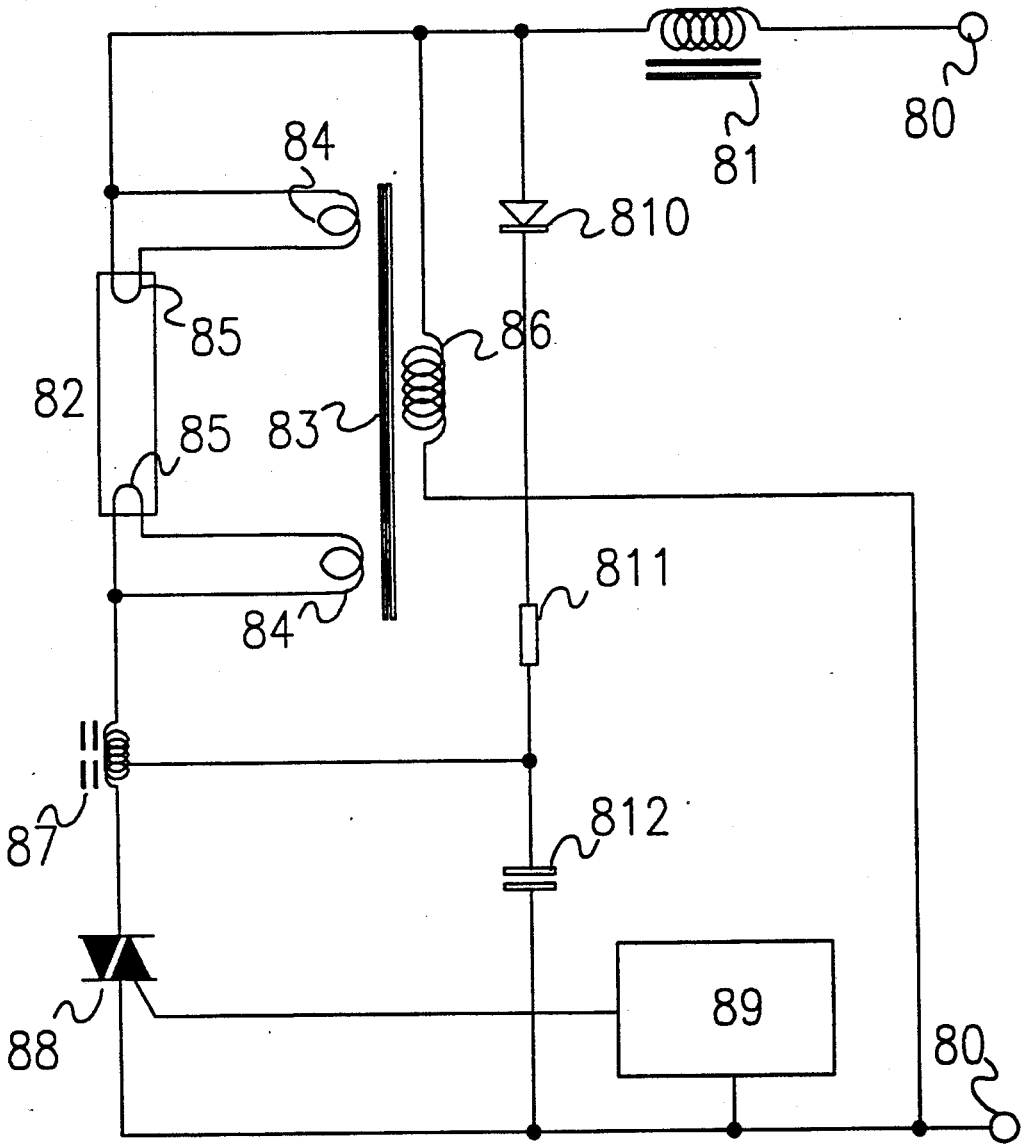
FIG. 8: is a circuit diagram for starting and flashing a fluorescent lamp which illustrates the use of a bidirectional TRIAC instead of a unidirectional SCR control device.
Figure 9:
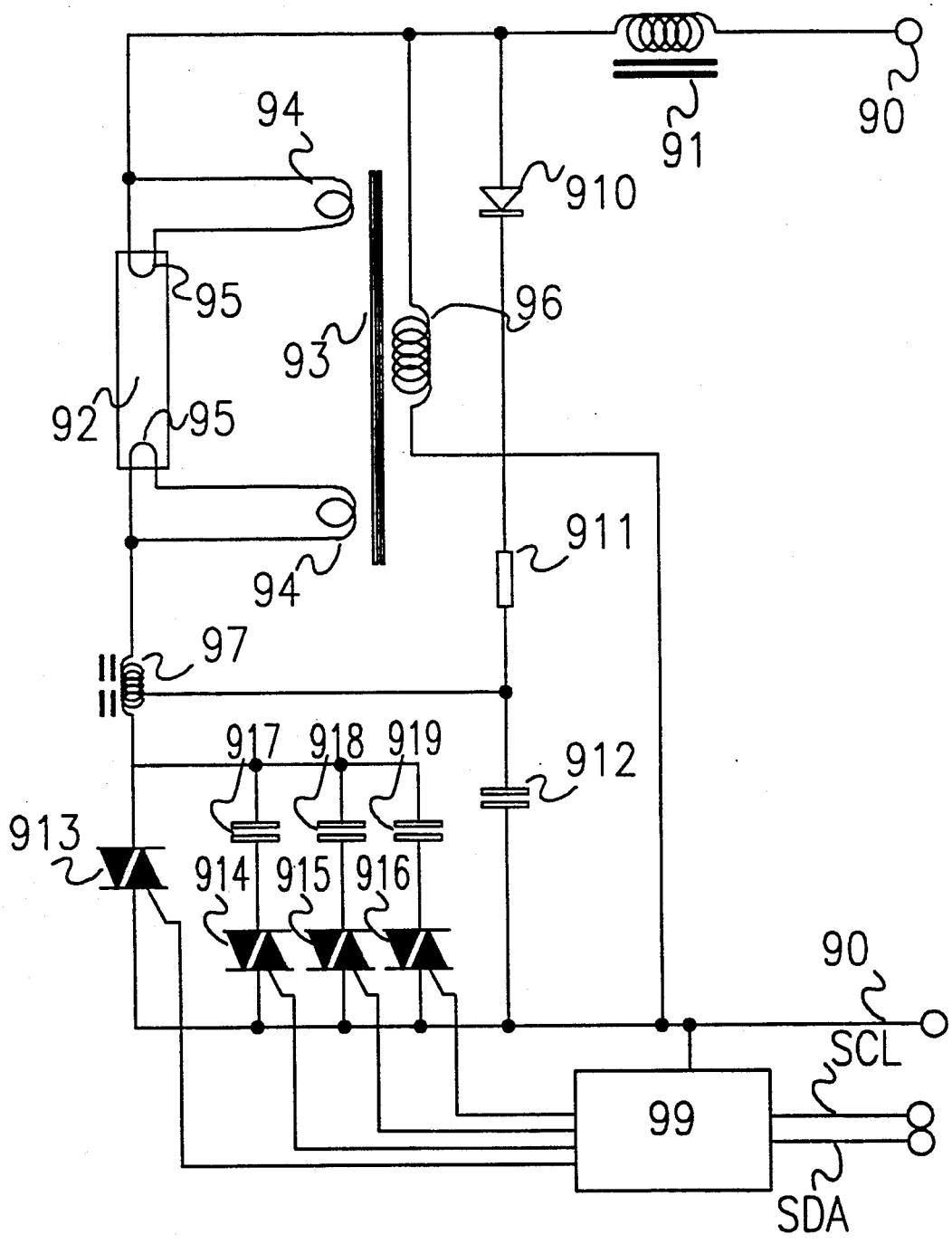
FIG. 9: is a modification of the preceding circuit diagram for starting and flashing a fluorescent lamp which illustrates the use of an array of TRIACs with series capacitors to modulate the intensity of the emitted light, under digital control.

FIG. 3 is an illustration of a preferred embodiment of the present invention. This preferred embodiment uses a unidirectional semiconductor, a thyristor or SCR. (FIG. 8 illustrates the use of a bidirectional device.) The novel circuit, also referred to as a pulse-start solid-state relay, is generally indicated by 30 in FIG. 3; the prior art section in the lower half (comprising elements 31, 31, 32, 36, 35, 35, 33, 34, and 34) is based on the earlier figures. The novel circuit is wired in series between the lamp and the ballast. In this example, the component values are described for a 230 volt AC mains supply but it will be appreciated that the invention is applicable to a 110 V AC supply or AC supplies of other voltages.

In FIG. 3, the AC mains is fed to contacts 31 and 31. A ballast 36 and cathode heater transformer secondary windings 35, 35 of the heater transformer 32 are connected to the cathodes 34 of the fluorescent lamp 33 according to the prior art in FIG. 1. However the link between one end of the lamp and the ballast is broken in this Figure, and the novel circuit 30 (the solid-state pulse-start relay) is inserted in series with the lamp.

Figure 4:
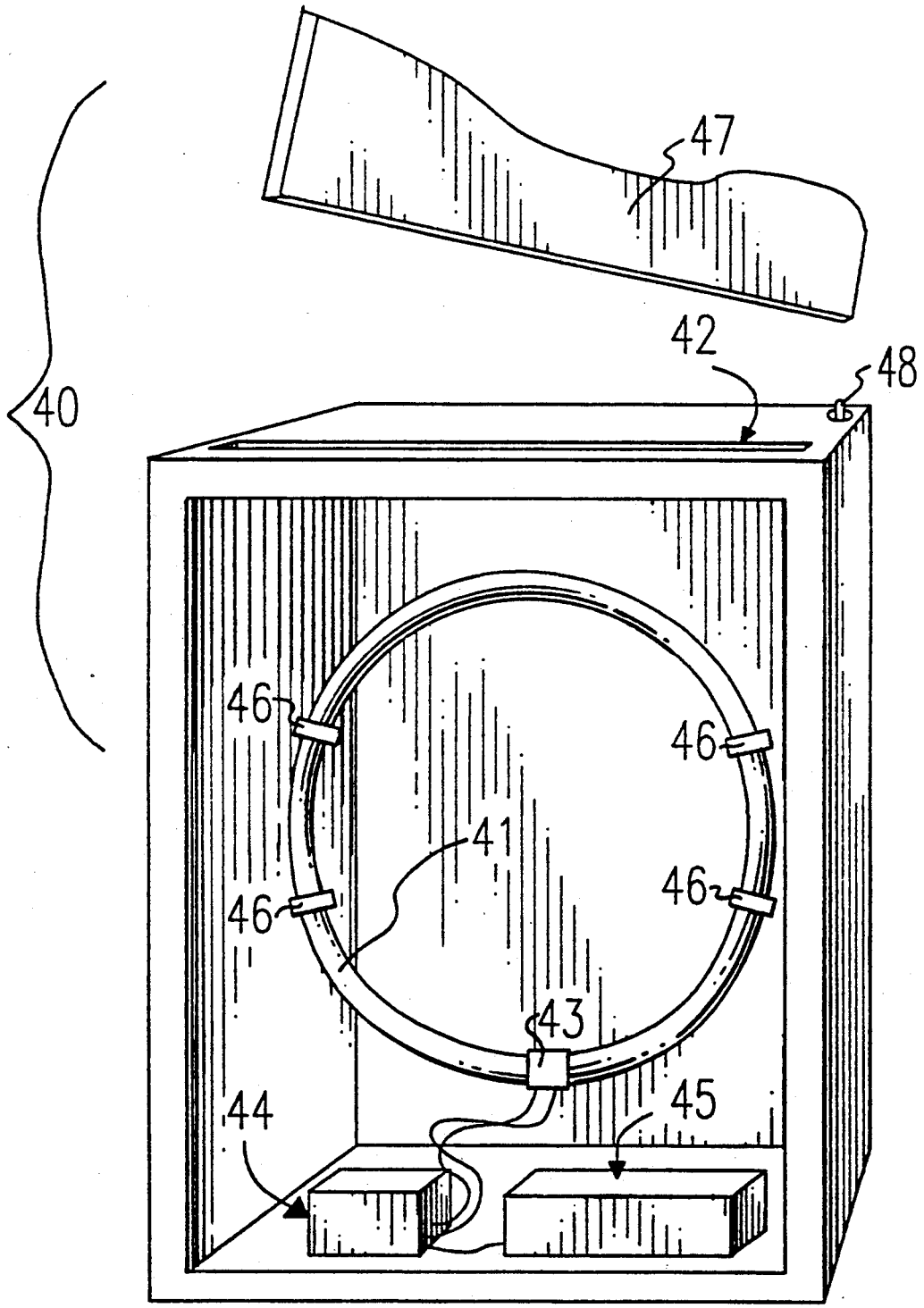
FIG. 4: is an illustration of a preferred embodiment of an advertising display which incorporates the flashing circuit.
Figure 5:
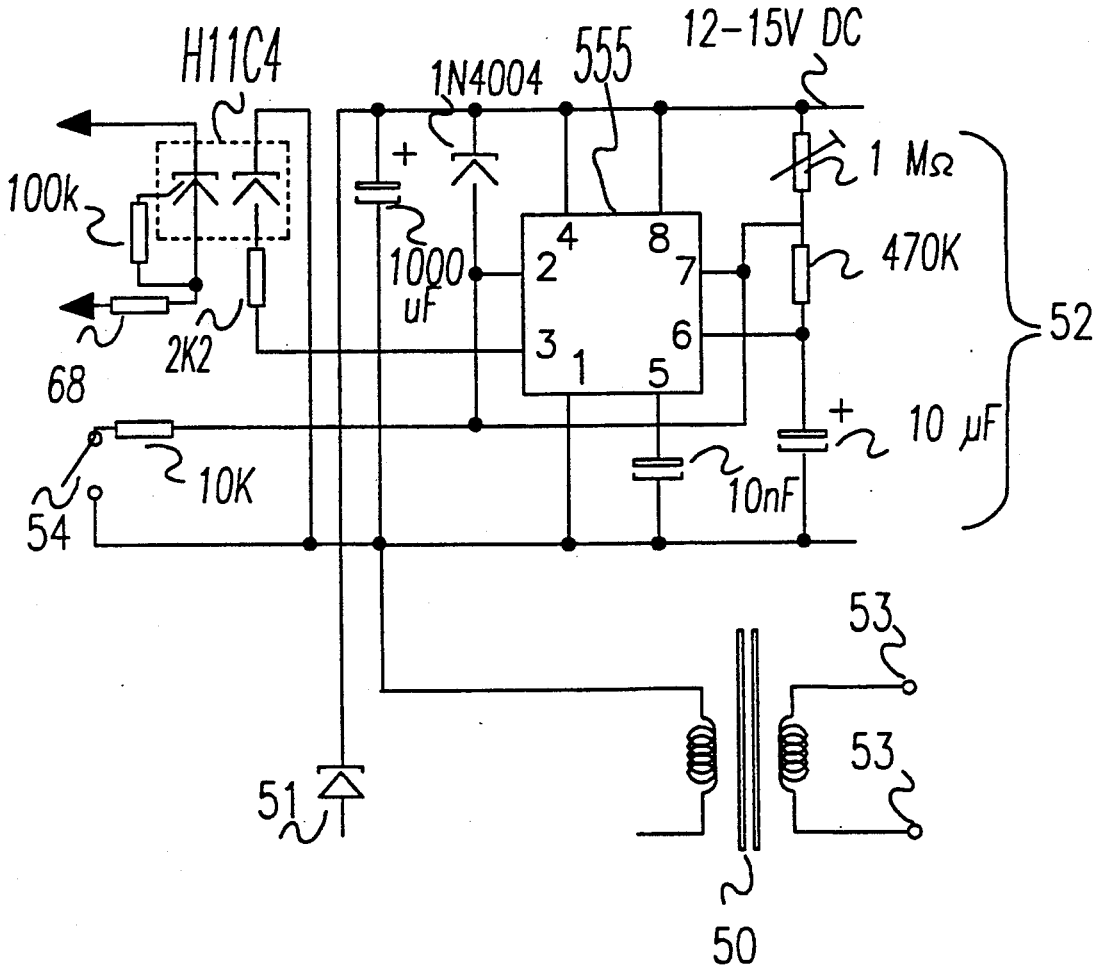
FIG. 5: is an illustration of a preferred embodiment of the flashing circuit embodied within the advertising display.

It receives controlling signals via the control line 313 from the box 312, preferably an optically isolated device such as a light-activated silicon-controlled rectifier, type H11C4, as disclosed in FIG. 5. In turn this optical isolator may be driven by (for example) a simple and common low-frequency square-wave oscillator, such as the well-known type 555 integrated circuit with ancillary components, (see FIG. 5) or it may as just one of many alternatives be a co-ordinating control line linking other similar flashing units. Box 312 may be controlled via an external control line 314, eg to over-ride the oscillator to keep the lamp switched on (ie not flashing) or to control the rate and duty cycle of flashing from switch 48 of FIG. 4.

A resistor 37, between the circuit 30 and the far leg 32 of the mains supply, serves to charge up a capacitor 310 with energy to be using during starting. The capacitor 310 typically has a value of 47 nanofarads and a rating of 400 V, for 230 volt mains applications. The silicon-controlled rectifier or SCR 39, preferably type CD 106 M (peak reverse voltage 600 V; gate current 0.2 mA, gate voltage 1.0 V) causes that stored energy to be discharged through the primary winding of the pulse transformer 311 immediately gate current flows from the wire 313. A high-voltage pulse is thereby induced in series with the lamp 33 and between the connections 31, 31 of the mains supply—though the ballast 36 and the heater transformer will tend to block its further passage.

The pulse rapidly ionizes the lamp gases and establishes the arc discharge. Mains current then flows via the lamp ballast and the pulse start solid state relay.

Once the lamp arc current is initiated, mains current flows via the fluorescent ballast 36, the bridge rectifier 38 and the SCR 39 and then through the pulse transformer 311. The bridge rectifier 38 now serves to render the lamp current unidirectional, as seen by the SCR 39. In more detail, current during the positive half-cycle would flow from the ballast 36 through D1 within the bridge rectifier 38, through the SCR 39, through D4, and then through the secondary of the pulse transformer 311 to reach the lamp. During the negative half-cycle, the other two bridge-rectifier diodes conduct so that current is still steered through the SCR device (or other conductivity modulated device) in the same direction as was the case for the positive half-cycles.

Once the lamp gas has been rendered conductive, the SCR 39 now serves to maintain lamp current. When the SCR gate current is removed, current continues to flow until its magnitude decreases below the SCR holding current at the end of the present half-cycle, at which point the SCR turns off. Inductive "kick-back" from the lamp ballast is therefore minimal.

Whether or not the SCR is maintaining lamp current, that portion of the circuit is at a positive potential in relation to the far side of the lamp. Before the lamp is activated the capacitor 310 must be charged up, typically to the peak value of the AC mains supply, by leakage current to the far side of the lamp through resistor 37, which in the preferred embodiment has a value of 0.47 megohms. The charging-up time constant is thus of the order of 0.1 seconds.

Capacitor 310 has a snubbing action providing a further degree of protection for the SCR against rapidly rising voltage transients or pulses. The inductance of the pulse transformer 311 limits current transients through the SCR 39.

During operation, the cathode heating transformer preheats the lamp cathodes 34, 34, and it should be noted that this preheating requirement in part prevents the unit from being used to instantly start a lamp by applying power to the whole unit, fixture, or fitting. In the preferred embodiment about 6 or 7 volts is applied when the lamp is "off". When the lamp has struck the cathode heating is reduced by the ratio of lamp volts to mains supply volts, typically 100:230. When the SCR 39 is set to become off the in-series circuit 30 becomes an open circuit, the lamp current is completely interrupted, and cathode heating is resumed. The resistor 37 passes enough current to charge the capacitor 310 while the lamp is not conducting. The pulse start solid state relay capacitor stores the required energy to generate the start pulse.

The pulse voltage and energy required to strike a fluorescent lamp differs for various lamp lengths and gas pressures.

FIG. 4 illustrates an application of the invention within an advertising display. The display 40 consists of a box with an open front 41, which is normally filled by the translucent advertising material 47, having in this particular embodiment dimensions of or slightly greater than the A3 international paper size, slipped into a frame to the front of the box through a slit 42. Inside the box a circular fluorescent lamp 43 is held in place with four clips 46. 44 and 45 represent the ballast inductor and the circuit as described in FIG. 3. In this preferred embodiment, controls such as the switch 48 may be provided for the user of the sign to determine the existence, the rate, and the duty cycle of flashing of the fluorescent lamp, by substituting external controls for the resistors that set the timing cycle of the 555 integrated circuit depicted in FIG. 5.

FIG. 5 shows a cyclic timing circuit suitable for the flasher circuit. In FIG. 5 a conventional circuit for using the well-known 555 type of integrated-circuit timer connected as an astable oscillator is shown. The timing pulse and duty cycle in this type of circuit is set by the values of the 1 MΩ, and 470 K resistors at top right, with the 10 uF capacitor below. Timing is substantially independent of the actual supply voltage. The circuit is shown with an isolated power source—the transformer 50 connected to the mains inputs 53, 53. Of particular note is the isolated interface between the output from the 555, from its pin 3, with the SCR device of the preferred embodiment of the solid-state pulse-start relay (eg 39 in FIG. 3, or 78 in FIG. 7). A light-activated SCR (type H11C4) is used to provide isolation while supplying gate current to the semiconductor switching device in the pulse-start solid-state relay circuit (see FIGS. 3, 7, or 8) although if the power fed to this circuit is isolated and user controls are made safe optical isolation may not be used.

54 is a flash or no-flash switch used to disable the oscillator and hence provide a steady light. It is displayed as 48 in FIG. 4, accessible to the operator.

FIGS. 6 WITH 3: CIRCUIT OPERATION

Figure 6:
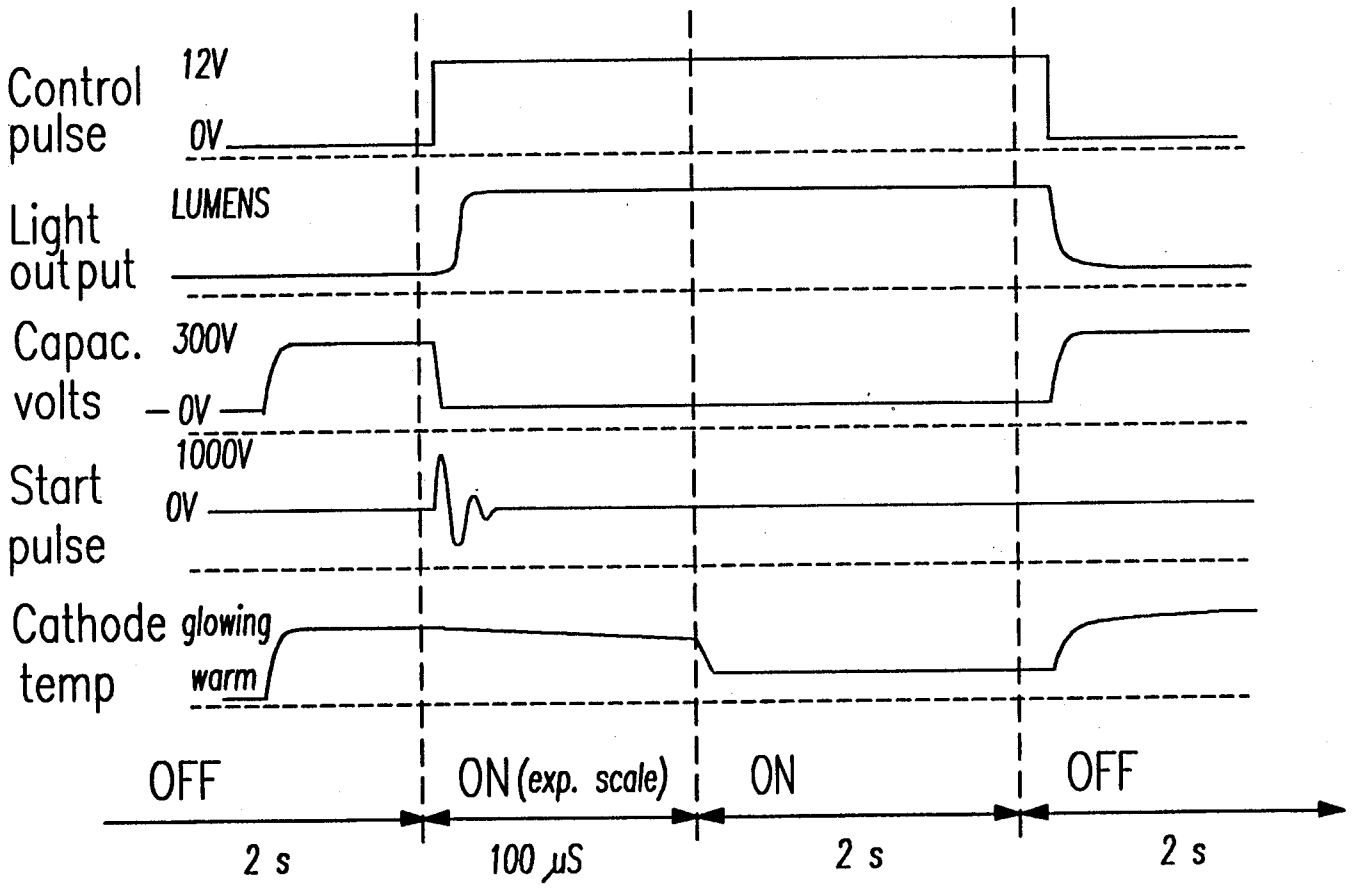
FIG. 6: is a diagram illustrating the time course of events during the onset and cessation of light from a preferred embodiment of the flashing circuit.

FIG. 6 shows the time course of events associated with the solid-state pulse-start circuit. Time advances from left to right, and one portion of the time scale has been expanded to better illustrate brief events. Note that this diagram does not take account of the alternating nature of a 50 or 60 Hz AC supply; no superimposed ripple is shown. From the top, the diagram shows the time course of the control pulse, the light output, the voltage across the capacitor 310 (FIG. 3), the start pulse, and the cathode temperature.

The circuit of FIG. 3 has the following method of operation; assume the semiconductor switch, shown by way of example as a silicon-controlled rectifier or SCR as 39 in FIG. 3, is non conducting and the capacitor 310 is charged to the peak mains voltage. At the point where the time scale is labelled "ON" (expanded scale) the control pulse is brought high by some external event. Current into the gate electrode causes the SCR 39 to be triggered into conduction. Typically an external signal will be applied from the controlling device 312 via the wire 313 to reach said gate electrode. Substantially all of the energy stored in capacitor 310 is discharged into the primary winding of the pulse transformer 311. The inductance of the pulse transformer becomes resonant with the capacitor 310, thereby generating a high frequency sinusoidal decaying pulse, as shown by the "Start pulse" waveform in FIG. 6. The pulse transformer has a very low impedance at the mains supply frequency, and is typically of ferrite construction.

The pulse voltage developed across the primary of the pulse transformer is stepped up by the pulse transformer's turns ratio, which is preferably 40:120 to above 1000 volts; a voltage sufficient to strike the fluorescent lamp or lamps. The optimum strike voltage varies for different types of lamp and it is preferable to provide pulse transformers having different turns ratios to cater for different types of lamp. The frequency of the sinusoidal pulse, determined by the inductance and capacitance of the resonant circuit formed by 310 and 311, is preferably made lower than any widely used radio frequency (for example it may be 150 KHz).

In practice it has been found that a fluorescent lamp will strike within one cycle of the high frequency pulse. This satisfies the short glow discharge period requirement for good lamp life. Light output rises rapidly, as indicated by the curve for "light output".

Once the lamp arc current is initiated, mains current flows via the fluorescent ballast 36, pulse transformer 311, bridge rectifier 38 and the SCR 39. The bridge rectifier now serves to render the lamp current unidirectional, as seen by the SCR 39, which now serves to maintain lamp current. When the SCR gate current (from 313) is removed, the SCR will cease to conduct at the end of the present half-cycle. (Other types of semiconductor switch may not exhibit the same convenient zero-switching effect and may require minor circuit changes). This state is maintained as long as the SCR 39 (or other device used for that purpose) remains in the conductive state. When it stops conducting, by reason of the control line dropping, light output falls, the capacitor 310 becomes fully charged (in around a tenth of a second for the preferred circuit values) and as a consequence of the voltage across the lamp and pulse-start solid-state relay circuit rising to the mains voltage, the heater transformer delivers full output and warms the heaters for the next strike.

When the SCR 39 is off and non-conducting the lamp current remains at zero. Capacitor 310 charges to the peak mains voltage via resistor 37. The circuit operation may be repeated once capacitor 310 attains full or at least sufficient charge.

FIG. 7

This is a circuit diagram illustrating the configuration of a preferred embodiment of a two-lamp circuit capable of providing control for flashing purposes, and incorporating a leakage reactance transformer which has a step-up facility suitable for 117 V mains operation. The circuit also shows the preferred arrangement of two lamps, in series, though with minor modifications it will operate with one lamp, or more than two lamps, should the application require it.

Figure 7:
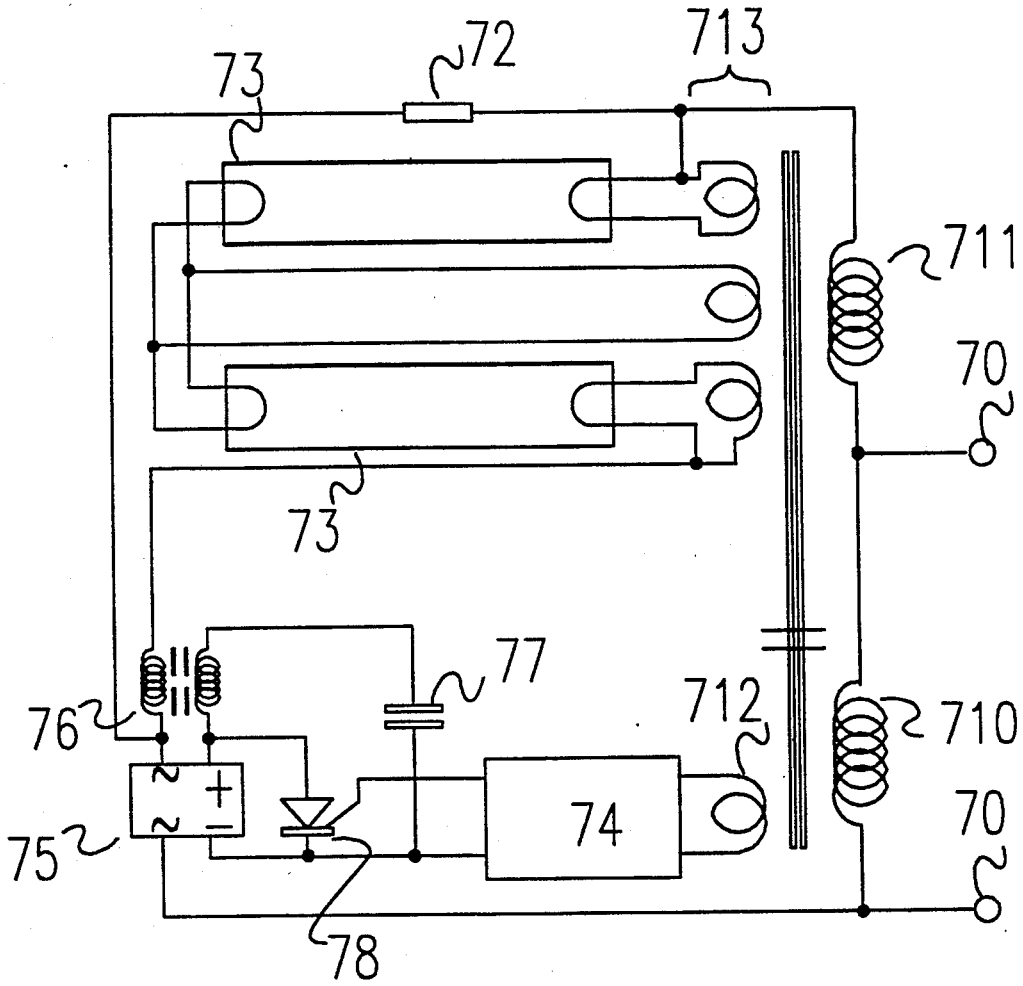
FIG. 7: is a circuit diagram illustrating the configuration of a two-lamp circuit incorporating a leakage reactance transformer, and suitable for 117 V mains operation.

In FIG. 7, the AC mains supply is connected to the terminals 70, 70. Current flows through the primary or common winding 710 of a leakage reactance transformer which, being in an autotransformer configuration, serves to step up the incoming voltage in winding 711. The type of magnetic coupling in such leakage reactance transformers also provides a current limiting action and thus replaces the ballast inductor of FIG. 1*a* (8), FIG. 1*b* (18), FIG. 2 (28), and FIG. 3 (36). Such transformers are generally available in the United States of America. The transformer also includes a secondary winding 712, to energise the flasher circuit 74, and three heater windings 713 for the two fluorescent lamps 73, 73 which are in series for the arc current though it should be noted that two heaters share a common transformer winding.

In this circuit, the novel solid-state pulse-start relay section is shown as items 75; a bridge rectifier, 76; a preferably ferrite-cored pulse transformer, 77; the capacitor which stores energy for the start pulse, 78; a silicon-controlled rectifier (SCR), and 72; a high-value resistor which supplies a charging current for the capacitor 77.

The circuit of the timer module 74 would preferably correspond to the circuit of FIG. 5 (transformer 50 now being winding 712) although any other device providing a suitable control pulse for the application in question could be substituted. For example a traffic lights application may use a microcontroller circuit to provide suitably sequenced control pulses, or an office lighting system may use proximity or infrared detectors to sense the presence of a person in the zone requiring lighting.

The voltage increase provided by this configuration of leakage reactance transformer provides sufficient voltage in practice to operate two fluorescent lamps in series, even when there is only a relatively low voltage supply.

FIG. 8

This preferred embodiment of the pulse-start solid-state relay incorporates a semiconductor switching device, namely a TRIAC, capable of controlling alternating currents. By way of comparison with FIGS. 3 or 7 it should be noted that the bridge rectifier is not used in this circuit, and a DC charging current is needed only for the first strike since the arc is never completely extinguished once struck, due to reactance current through the capacitor 812.

The alternating-current mains supply is provided through the terminals 80, 80, preferably with the phase leg connected to the ballast 81 in order to allow neutral-referenced and non-isolated control signals to be applied to the flasher circuit 89 or directly to the TRIAC 88. Reversing the terminals simply affects the convenience of control connections.

As for the prior art, the current through the fluorescent lamp (or lamps) is limited by the impedance of the ballast inductor 81 and cathode heating is provided by the transformer 83, with primary winding 86 and secondary heater windings 84, 84, though a reactance transformer of the type illustrated in FIG. 7 may be substituted for use in particular with multiple lamps and low-voltage mains supplies.

In this circuit the lamp 82 is connected in series with a pulse transformer 87, the TRIAC 88, and the ballast 81 across the mains supply. Its cathodes 85, 85 are energised from the windings 84, 84 at a higher voltage when the lamp 82 is nonconducting because the heater transformer primary winding 86 is connected across the lamp.

When the circuit is first energised, no current flows through the lamp and a DC current flows through the diode 810 (preferably type 1N4007), the resistor 811 (preferably 470K ohms) and charges the capacitor 812 (preferably 47 nF, 400 V). On the arrival of a first control pulse at the gate electrode of the TRIAC 88 it conducts thereby causing the capacitor 812 to discharge through the common section of the winding of the pulse transformer 87 thus generating a high voltage impulse in the manner of preceding circuits with which to strike the arc.

Lamp arc current continues to flow at normal strength as long as the TRIAC remains in its conductive mode, as long as current flows in its gate electrode and on until the next zero-crossing moment. Once the TRIAC becomes non-conductive, lamp arc current continues to flow through the capacitor 812 which presents a reactance of approximately 6,000 ohms and therefore the lamp continues to glow faintly. In contrast, the circuit illustrated in FIG. 3 provides for complete cessation of lamp current. The capacitor does not, in this preferred embodiment, regain a steady DC charge. Because the arc is still struck it need not be restruck when the TRIAC 88 is again made conductive and lamp life is further extended as periods of glow discharge do not subsequently occur during flashing modes of operation.

In contrast to FIGS. 3 and 7, for instance (in which the semiconductor switch is floating at a high voltage) the control electrode for the TRIAC type of semiconductor switching element may be supplied with control currents referenced to the neutral line, which renders the linkage of multiple circuits according to this embodiment easier to implement as otherwise a technique such as optical isolation is required. The box 89 may represent a flasher circuit (see FIG. 5 for one embodiment) which may be provided with user controls, or it may represent part of an overall synchronisation or linkage unit for multiple illumination or display devices incorporating the circuit.

FIG. 9

This circuit is based on FIG. 8 but includes a preferred means to modulate, or dim, the intensity of the light.

90 and 90 represent the AC mains connections, with the phase leg preferably connected to the ballast 91, 92 is the lamp, though a plurality of lamps may be used according to the information pertaining to FIG. 7. The transformer 93 provides heating current to the lamp cathodes 95, 95 from windings 94, 94, and is energised by primary winding 96. Diode 910 (1N4007) and resistor 911 (470K ohms) provide initial charging current for capacitor 912.

To start the circuit, TRIAC 913 is made conductive by current passing into its gate electrode from the interface 99. This causes capacitor 912 to discharge through the TRIAC and step-up pulse transformer 97, thereby generating a brief high-voltage pulse to strike the arc in the lamp 92. Once the arc has been struck, one or more of a combination of TRIACs 914, 915, 916 may be switched on and TRIAC 913 may be switched off. Series capacitors 917, 918, 919 are selected to provide a graded and preferably a binary series of reactances so that any one brightness level from a range of possible levels may be synthesised by energising one or more TRIACs. While three TRIACS are depicted in the dimming section in this figure, the preferred interface chip, a "Phillips" PCF 8574, has eight outputs so 128 levels plus fully on are possible. The interface chip 99 is designed to be linked to the $I^2C$ serial data bus, and up to sixteen chips of this type may be addressed separately from a single pair of data wires. The $I^2C$ bus also has a ground wire and a five-volt line, not shown here.

ADVANTAGES OF PREFERRED CIRCUIT

There are several significant features of the solid-state pulse-start circuit when used as a flasher circuit:

1. Control of the timing of the illumination cycle is precise.

2. Full cathode heating is applied only when the lamp plasma is not carrying current; this minimises thermal rise in a fitting.

3. The single pulse strike voltage prevents the possibility of long glow discharge periods, which are the most common cause of lamp end blackening and short lamp life.

4. The starting technique ensures the best possible start for a large range of lamps operated over a wide temperature.

5. If two or more lamps are operated in series, they strike simultaneously.

6. Multiple circuits may be linked by the same control line or control system to provide flashing in synchronism, light chasing, or some other special effect.

This is generally cheaper to effect in the case of circuits using the ground-referenced TRIAC type of circuit.

7. In versions using unidirectional control devices such as a SCR, if the SCR is turned off the lamp current becomes substantially zero. This ensures the maximum contrast between on and off states for displays etc.

8. The circuit is best suited to 26 mm diameter lamps and the new generation "PL" (NV Philips Gloielampenfabrikien) and "2D" (Thorn plc) lamps, which share characteristically high strike voltages. These lamps offer improved efficiency when compared to the older 38 mm diameter lamps, some of which are not readily available.

9. The circuit incorporates two inherent levels of protection against excessive changes in voltage with time, and changes in current with time which may destroy semiconductor devices.

10. The start pulse is a well defined sinusoidal voltage, applied in series with the lamp(s) and the supply. Radio frequency interference is negligible because the strike current is asynchronous, and at a relatively low frequency.

11. The circuit has a low component count.

12. The circuit may have a dimmer option added, and can then provide a range of discrete brightness levels as well as fully on.

There are several significant features of the circuit when used as a starter circuit especially for lamps which are turned on and off repeatedly:

A. Response to control signals is effectively instantaneous and immediate.

B. Lamp life is substantially longer than for an incandescent lamp run at its design voltage when subjected to comparable cyclic energisation. This feature suggests that traffic lights for instance would benefit from use of these lamps rather than incandescent lamps.

POSSIBLE VARIATIONS OF THE PREFERRED EMBODIMENT

1. The fluorescent ballast and the cathode heating transformer may be combined on the one core to form a leakage reactance transformer. The leakage reactance transformer may also step up the incoming AC voltage.

2. The pulse start solid state relay may be inserted in series with the lamp either on the phase or neutral line.

3. More than one lamp may be operated in series, via additional cathode heating transformer windings, and by a provision for a higher supply voltage, which may be derived by a step-up leakage reactance transformer.

4. The pulse start solid state relay may have the following variations.

(a) Apart from a SCR (thyristor) or a TRIAC, the semiconductor switching device may be selected from a range including any other gateable or switchable semiconductor with suitable voltage and current ratings ie MOSFET, TRANSISTOR, INSULATED GATE TRANSISTOR (IGT), GATE TURNOFF (GTO) device, or the like.

(b) The circuit may be constructed in other configurations which provide the same operating functions as the pulse start solid state relay. These functions are specified as "resembling a switch, which when turned on, generates a first pulse voltage of additional magnitude and energy, and then maintains a flow of a lesser current as long as it is required". In the preferred embodiments, the first pulse is preferably sufficient to strike an arc through a fluorescent lamp.

Various other alternations and modifications may be made to the foregoing without departing from the scope of this invention as exemplified by the following claims.

We claim:

1. Apparatus for providing from a source of alternating electric power the igniting and operating voltages for a gas discharge lamp, or lamps in series, said apparatus comprising:

a step-up transformer; switching means; charge storage means; means for charging said charge storage means; and switch control means to cause said switching means to be in either an "on" state or an "off" state; said switching means and said charge storage means being connected in series with said step-up transformer to provide, when said switching means is closed, a series resonant circuit; said step-up transformer being connected in series between the gas discharge lamp and the switching means; said switching means being connected in series with said lamp or lamps whereby in use with said switching means and the gas discharge lamp connected to the source of alternating electric power, operation of the control means to switch "on" said switching means to cause it to conduct thereby allows said charge storage means to discharge transient current through said step-up transformer, causing an ignition pulse of high voltage to be created within said step-up transformer available to ignite said gas discharge lamp or lamps, and once ignited said lamp or lamps can continue to draw current from said power source via said step-up transformer and through said switching means, and operation of the switch control means in the "off" sense to act on said switching means will thereby switch "off" the lamp or lamps.

2. Apparatus as claimed in claim 1, wherein said switching means comprises a semiconductor device having a control line connected to said control means so that a signal applied to said control line can be used to switch said switching means "on" or "off".

3. A lighting circuit comprising a low pressure gas-discharge lamp, or a plurality of said lamps connected in series, the or each lamp having resistively heated cathodes, means for connecting said lamp or lamps to a source of alternating electric power, means for limiting the flow of current through the circuit and means for controlling and igniting said lamp or lamps, said controlling and igniting means comprising step-up transforming means having primary and secondary windings; switching means; charge storage means; means for charging said charge storage means and switch control means to cause said switching means to be in either an "on" state or an "off" state; said switching means and said charge storage means being connected in series with said primary winding to provide, when said switching means is closed, a series resonant circuit; said secondary winding being connected in series between the gas discharge lamp and the switching means; said switching means being connected in series with said lamp or lamps; said switching means and the gas discharge lamp or lamps being connected in series with the source of alternating electric power, with a first power connection at a point between the switching means and the charge storage means, and a second power connection to a remote end of the lamp or series of lamps; whereby in use, operation of the control means to switch "on" said switching means to cause it to conduct thereby allows said charge storage means to discharge transient current through said step-up transforming means, causing an ignition pulse of high voltage to be created within said step-up transforming means available to ignite said gas discharge lamp or lamps, and once ignited said lamp or lamps can continue to draw current from said power source via said step-up transforming means and through said switching means, and operation of the switch control means in the "off" sense to act on said switching means will thereby switch "off" the lamp or lamps.

4. A lighting circuit as claimed in claim 3, wherein said switch control means comprises means for repeatedly varying the conductivity of said switching means to cause said lamp or lamps to emit light in repeated flashes.

5. A lighting circuit as claimed in claim 4, wherein said switching means comprises a unidirectional silicon controlled rectifier or thyristor together with a bridge rectifier.

6. An illuminated display device comprising the lighting circuit as claimed in claim 3, and means for holding advertising or display material in proximity to said lamp or lamps.

7. The illuminated display device as claimed in claim 6, wherein said switch control means comprises means for repeatedly varying the conductivity of said switching means to cause said lamp or lamps to emit light in repeated flashes.

8. A lighting circuit comprising a low pressure gas-discharge lamp, or a plurality of said lamps connected in series, the or each lamp having resistively heated cathodes, means for connecting said lamp or lamps to a source of alternating electric power, and means for controlling said lamp or lamps; said controlling means comprising step-up transforming means, first bidirectional switching means, charge storage means, means for charging said charge storage means, and switch control means to switch said first bidirectional switching means "on" or "off"; said first bidirectional switching means and said charge storage means being connected in series with said step-up transforming means to provide, when said first bidirectional switching means is closed, a series resonant circuit; said step-up transforming means being connected in series between the gas discharge lamp and the first bidirectional switching means; said switching means being connected in series with said lamp or lamps and said first bidirectional switching means and the gas discharge lamp or lamps being connected in series with the source of alternating electric power; whereby in use, operation of the control means to switch "on" said first bidirectional switching means to cause it to conduct thereby allows said charge storage means to discharge transient current through said step-up transforming means, causing an ignition pulse of high voltage to be created within said step-up transforming means to ignite said gas discharge lamp or lamps, and once ignited said lamp or lamps can continue to draw current from said power source via said step-up transforming means and through said switching means, and operation of the switch control means to switch "off" said first bidirectional switching means will switch "off" or "dim" the lamp or lamps.

9. A lighting circuit comprising a low pressure gas-discharge lamp, or a plurality of said lamps connected in series, the or each lamp having resistively heated cathodes, means for connecting said lamp or lamps to a source of alternating electric power, and means for controlling said lamp or lamps; said controlling means comprising step-up transforming means having primary and secondary windings, first bidirectional switching means, charge storage means, means for charging said charge storage means, and switch control means to switch said first bidirectional switching means "on" or "off"; said first bidirectional switching means and said charge storage means being connected in series with said step-up transforming means to provide, when said first bidirectional switching means is closed, a series resonant circuit; said step-up transforming means being connected in series between the gas discharge lamp and the first bidirectional switching means; said first bidirectional switching means and the gas discharge lamp or lamps being connected in series with the source of alternating electric power; and at least one additional bidirectional switching means, connected in series with respective current limiting means, and connected in parallel with said first bidirectional switching means, said switch control means being adapted to switch "on" one or more of said bidirectional switching means to incrementally vary the amount of illumination emitted by said lamp or lamps; whereby in use, operation of the switch control means to switch "on" said first bidirectional switching means to allow it to conduct thereby allows said charge storage means to discharge transient current through said step-up transforming means, causing an ignition pulse of high voltage to be created within said lamp or lamps, and once ignited said lamp or lamps can continue to draw current from said power source via said secondary winding, and operation of the switch control means to switch "on" or "off" said first or said additional bidirectional switching means will allow the brightness of the lamp to be controlled.

10. A lighting circuit as claimed in claim 9, wherein said first and said additional switching means each comprises a bidirectional thyristor or TRIAC.

* * * * *